United States Patent [19]

Zidele

[11] 4,227,263

[45] Oct. 14, 1980

[54] REVERSIBLE BASEBALL GLOVE

[76] Inventor: Israel Zidele, 1303 Ditmas Ave., Brooklyn, N.Y. 11226

[21] Appl. No.: 46,798

[22] Filed: Jun. 8, 1979

[51] Int. Cl.[2] ..... A41D 13/10

[52] U.S. Cl. ..... 2/19

[58] Field of Search ..... 2/19, 16, 20, 159, 161 R, 2/161 A, 158, DIG. 2

[56] References Cited

U.S. PATENT DOCUMENTS

| | | | |
|---|---|---|---|
| 1,003,031 | 9/1911 | Cline | 2/19 |
| 2,521,488 | 9/1950 | Smith | 2/19 |
| 3,042,929 | 7/1962 | Kobos | 2/19 |
| 3,300,787 | 1/1967 | Denkert | 2/19 |

*Primary Examiner*—H. Hampton Hunter
*Attorney, Agent, or Firm*—Karl F. Ross

[57] ABSTRACT

A baseball glove, usable by both right-handed and left-handed players, has two outer finger stalls, two intermediate finger stalls and a middle finger stall, at least the latter three stalls being integral with front and rear pieces of leather or similar sheet material held together by lacing which also links one of the outer stalls and the adjoining intermediate stall to an interposed web. The two outer stalls may be structurally identical, so as to receive either the thumb or the little finger of a player according to the latter's handedness, and may have downward extensions protectively overlying the player's palm. Alternatively, all five finger stalls may be integral with the two coextensive sheets to be selectively used as either the front or the back of the glove; the lacing in that case may be unitary but loose enough in places to allow flexing in one direction or the other, depending on which hand is inserted between one of these sheets and an intervening padding.

13 Claims, 9 Drawing Figures

REVERSIBLE BASEBALL GLOVE

FIELD OF THE INVENTION

My present invention relates to a reversible baseball glove.

BACKGROUND OF THE INVENTION

Baseball mitts or gloves are known, e.g. from U.S. Pat. No. 2,521,488, which can be used with either the left or the right hand by having a compartment formed between a removable padding and one of two sheets, the padding coming to lie against the palm of the inserted hand. According to the disclosure of that patent, the stalls for the index and middle fingers are separated from the thumb stall by a relatively wide web of generally triangular shape and from the two remaining stalls, also joined together, by a similar but narrower web. It is also known to interconnect the front and rear sheets of a baseball glove by lacing which extends along the lateral sheet edges as well as along the peripheries of their extensions defining the finger stalls; see, for example, U.S. Pat. Nos. 2,324,219, 2,699,551, 2,281,315, 3,042,929, 3,098,234, 3,300,787 and 3,528,107. Some of these prior patents also show a web secured by the lacing to adjoining finger stalls.

A reversible baseball glove of the conventional type has the disadvantage that the front face of the glove, formed by either of the two peripherally interconnected sheets depending on which hand is being used, does not readily assume the proper concave shape required for the catching of an oncoming ball. Thus, if the two sheets are mutually coextensive when flat, the sheet coming to lie on the convex rear surface would have to be excessively stretched when the glove is curved forward by the player's fingers reaching for a ball.

OBJECTS OF THE INVENTION

An important object of my present invention, therefore, is to provide an improved baseball glove of the reversible type in which this disadvantage is obviated.

Another object is to provide means in such a baseball glove facilitating the circulation of air through its interior, especially at a time when the player exerts an extra effort in intercepting and firmly gripping a ball.

SUMMARY OF THE INVENTION

In accordance with a feature of my present invention, the two outer finger stalls of a baseball glove are of symmetrically indentical shape and wide enough to accommodate the thumb of the user while being attached exclusively by lacing to the front and rear pieces or sheets of the glove which are thus integral only with the middle and intermediate stalls accommodating the index, middle and ring fingers of the user. A web, usually made of the same tough and flexible sheet material (e.g. leather) as these front and rear pieces, is selectively retainable by the laving between either of the two outer finger stalls and the respectively adjoining intermediate finger stalls for enabling a wearing of the glove on either hand.

Since in this instance the same sheet acts as the front piece regardless of which hand is being used, the two sheets can be suitably shaped with the respective curvature by the manufacturer. Padding, of course, should be inserted between the sheets and may be permanently secured to the inner surface of the front piece. I prefer, however, to leave clearances between that padding and the front piece for enabling one of two symmetrical flaps integral with that front piece to be tucked in at the palm between the sheet and the padding on the thumb side of the glove; the other flap remains extended to give additional protection to the hand of the user just below his littler finger.

Pursuant to another feature of my invention, the two outer stalls respectively accommodating the thumb and the little finger are provided with downward extensions which enter between the front piece and the padding to give additional protection to the palm, these extensions being interconnected by a lace for positional stability.

In accordance with another aspect of my invention, all the finger stalls are integral with the front and rear sheets of the glove but the lacing interconnecting these sheets forms loose stretches extending across portions of both sheets for alternate tightening upon insertion of one or the other hand of the user. Such loose stretches of lacing could be disposed with the finger stalls, in the regions of the fingertips of the player, to support upward extensions of the padding which thus has a certain mobility in each finger stall to facilitate the insertion of either one or the other hand of the user. Alternatively, or in addition, loose stretches may extend across substantially horizontal slots in a heel section of each sheet for enabling alternate contraction and expansion thereof.

I further prefer to interconnect the sheets only loosely along their peripheries to form gaps between them facilitating air circulation through the glove.

BRIEF DESCRIPTION OF THE DRAWING

The above and other features of my invention will become more readily apparent from the following detailed description, reference being made to the accompanying drawing in which.

SPECIFIC DESCRIPTION

Figure 1A:
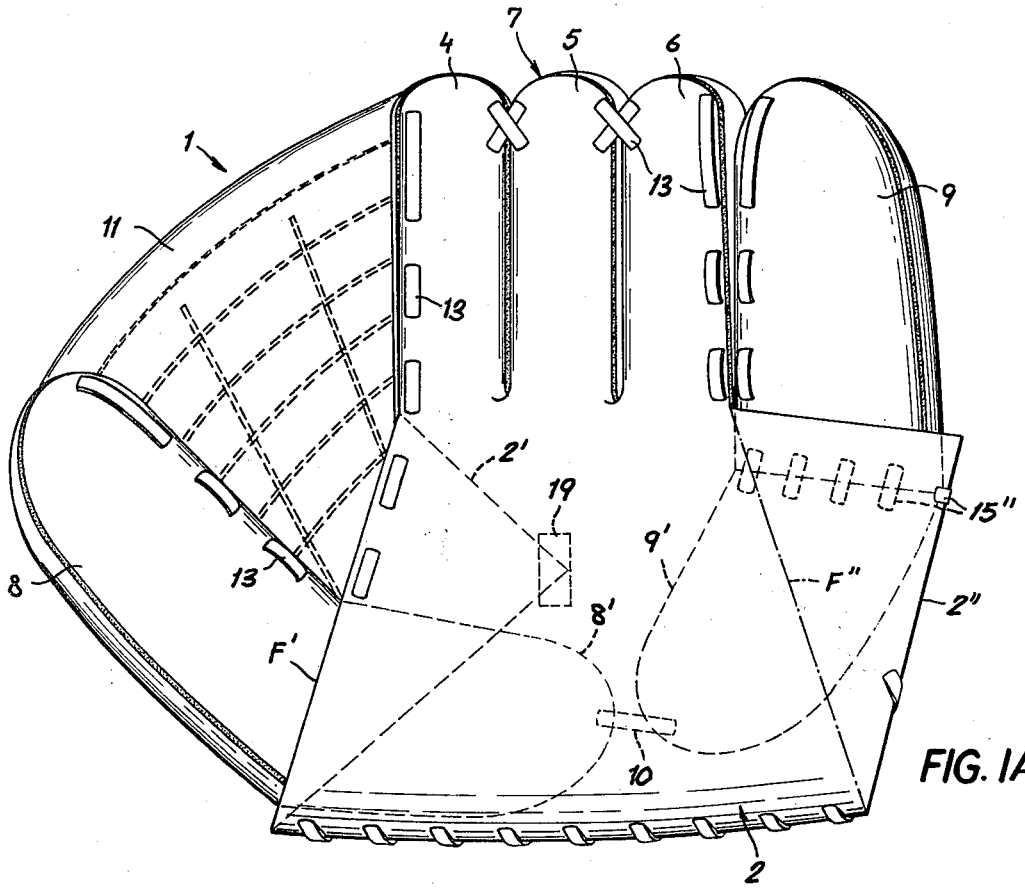
FIG. 1A is a front-elevational view of a baseball glove according to a first embodiment of my invention, adapted for left-hand use.
Figure 1B:
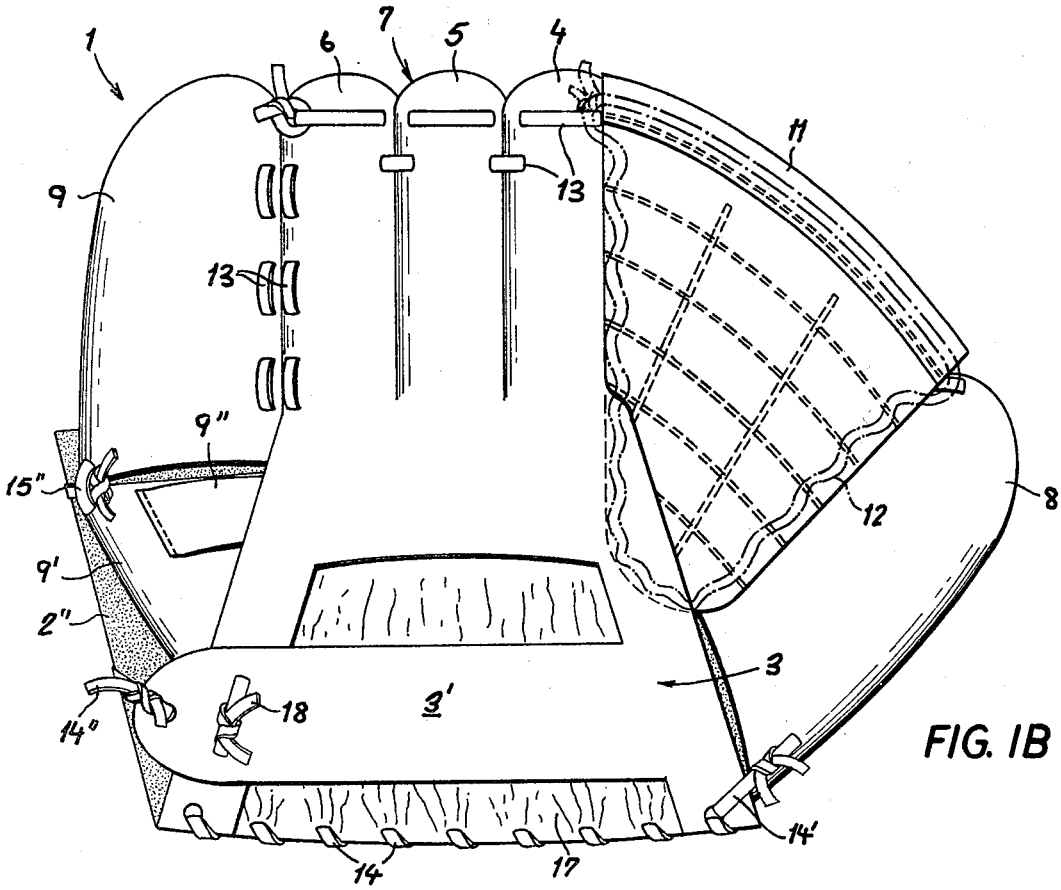
FIG. 1B is a rear-elevational view of the glove shown in FIG. 1A.
Figure 1C:
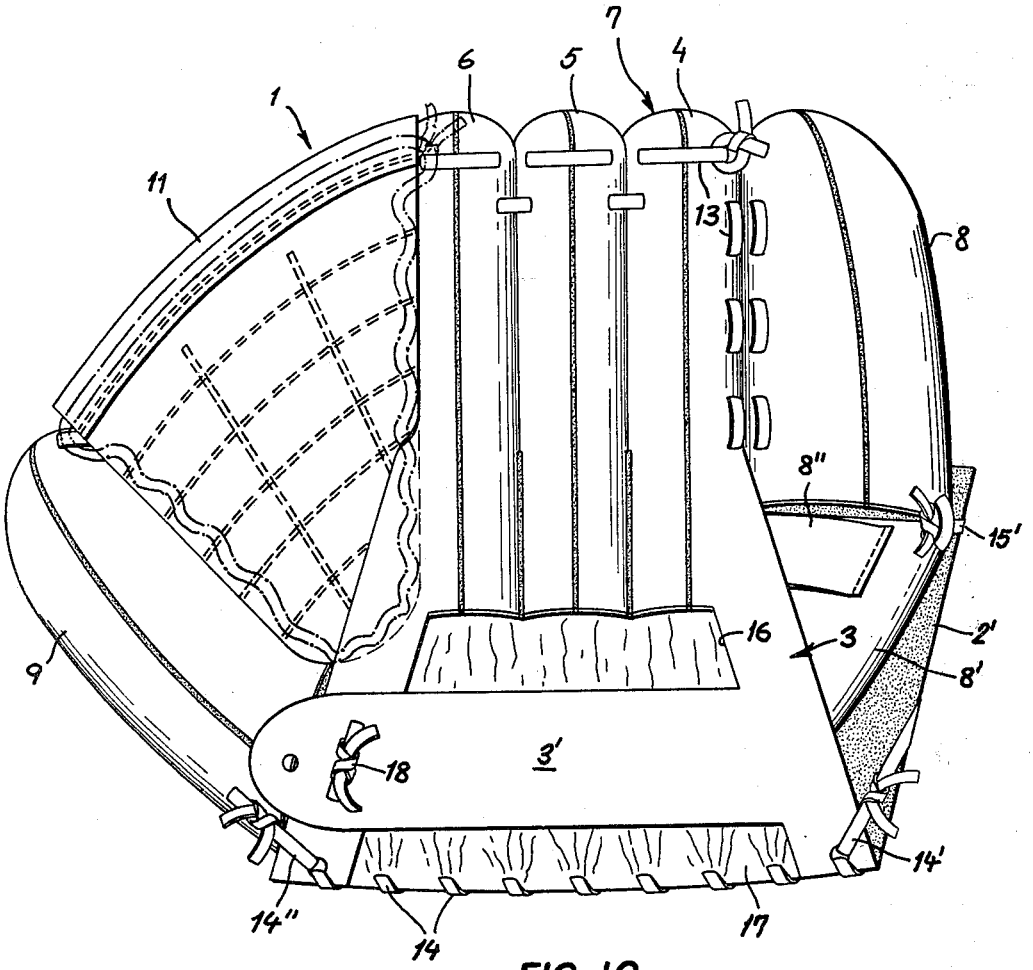
FIG. 1C is a view similar to that of FIG. 1B, showing a slightly different glove adapted for right-hand use.

The baseball glove 1 shown in FIGS. 1A–1C comprises a front piece 2 and a back piece 3 of tough, flexible sheet material, such as leather or vinyl plastic, having projections along which they are joined by seams to form finger stalls 4, 5 and 6 combined by top lacing 13 into a central unitary structure 7. Flanking the central structure 7 are finger stalls 8 and 9, which can be attached to that central structure in different positions for adapting the glove 1 for either right-hand or left-hand use. The two outermost finger stalls 8 and 9 are formed with repective lower extensions 8' and 9' which project between the front and back pieces 2, 3 and are joined by a lace 10 in the heel section of the glove, the extensions 8' and 9' providing padding for the central structure 7 and stability for the stalls 8 and 9.

A web 11 of similar sheet material can be positioned between outer and intermediate finger stalls 8 and 4 and attached thereto by ancillary lacing 12, shown in FIG. 1B in dot-dash lines, which interlinks with the top lacing 13 along the generally U-shaped outline of the web and adapts the glove 1 for left-hand use, the stalls 8 and 9 respectively accommodating the thumb and the little finger of the left hand of the user. In this position, the thumb stall 8 is attached to the central structure 7 through the intermediary of the web 11 and side lace 14' while the stall 9 is fastened thereto by the lacing 13. An additional side lace 15'' engages a flap 2'' which is formed along one side of front piece 2 and is mirror-symmetrical to another flap 2' formed along the opposite side of that piece.

As can be seen in FIG. 1A, both flaps 2' and 2'' are foldable about respective lines F', F'', diverging downwardly from the outer edges of stalls 4 and 6, so that one or the other flap—here flap 2'—can be tucked behind the front piece 2. Another lace 14'' anchors the lower end of the extended flap 2'' to the back piece 3, either directly (FIG. 1C) or through a hand-engaging strap 3' integral with that piece. A corner of the infolded flaps 2' is held in place by a centrally positioned thong 19.

When the glove 1 is to be adapted for right-hand use, as shown in FIG. 1C, the web 11 is positioned between outer and intermediate stalls 6 and 9 and attached thereto in the same manner as described above for left-hand use of the glove. Stall 9 now serves to accommodate the thumb of the right hand of the user while the stall 8 receives the little finger and is attached to the central structure 7 by top lacing 13 and side lace 15' engaging the unfolded flap 2'; flap 2''is folded behind front piece 2 and held in position by side lace 15'' (not shown in FIG. 1C) in a manner analogous to that illustrated for falp 2' and lace 15' in FIG. 1A. The finger stalls may be seamless, as shown in FIGS. 1A and 1B, or have seams as illustrated in FIG. 1C.

A ventilation-promoting cutout 16 spanned by strap 3' is formed in the rear piece 3, providing access to the interior of the glove for the hand of the user; the lateral boundaries of rear piece 3 register with fold lines F', F''. Strap 3' is held in position by a further short lace 18. Thongs 8'' and 9'' are loosely stitched to padding extensions 8' and 9', respectively, in order to engage the little finger of the left or right hand while an additional layer of padding 17 is provided on the inner surface of front piece 2 in the heel section of the glove as a protective liner overlying the padding 8', 9' as well as the tucked-in flap 2' and separating the hand of the user therefrom. A bottom lace 14 holds front piece 2, of padding 17 and the sides of back piece 3 together. The rear piece 3 could also be made identical with front piece 2, omitting the cutout 16 and the strap 3'.

In FIGS. 2A–2D I have shown a bistable baseball glove 21 designed to assume either of two positions of stability in which it can be respectively worn for right-hand and left-hand use. This is specifically illustrated in FIG. 2C where the solid lines show the glove adapted for left-hand use and the dot-dash lines show it adapted for right-hand use.

The bistable glove 21 is formed by two identical, unitary sheets 22 and 23 of leather or the like, loosely joined along their periphery by a single lace 33 tracing a sawtooth pattern, which allows a certain amount of play between the sheets 22 and 23 facilitating the shifting of the glove from one position to the other while also allowing for the circulation of air around the hand. A web 31 is positioned between the thumb stall 28 and the finger stall 24 and extends a short distance between sheets 22 and 23, as shown by its dotted outline 31'. A layer of padding 27 is inserted between the sheets 22 and 23; layer 27 extends across the palm area and into the stalls of the glove and is fastened at the sides thereof between the sheets, the padding 27 dividing the interior of the glove into two compartments respectively serving to accommodate the right hand or the left hand of the user.

The single lace starts at **33*a* below finger stall 29 and proceeds on the inner surface of sheet 23 to its heel portion where it undulates across a generally horizontal slot 23' thereof in a loose sawtooth stitch 33*b*, forming alternately longer and shorter loops. The lace then extends at 33*c* along the sheet 23 to the edge of the glove, where it engages the other sheet 22 and the padding 27 and continues upward along the edge of the thumb stall 28 in a loose sawtooth stitch 33*d* to a point $P_1$, allowing the formation of a gap 34 between the sheets as seen in FIG. 2D. There the lace leaves the thumb stall 28 and proceeds in a run 33*e* through a channel 31'' formed in the top edge of the web 31, engaging the finger stall 24 at a point $P_2$ whence it doubles back through the same channel in a run 33*e'* to the point $P_1$ and continues, in a sawtooth stitch 33*f*, downward along the thumb stall and upward along the finger stall 24 to the point $P_2$, hugging the edge 31' of the web 31. From point $P_2$, where it links up with its own loop 33*e*, 33*e'* traversing the channel 31'', the lace continues in a sawtooth stitch 33*g* along the outlines of finger stalls 24, 25, 26 and 29 to a point $P_3$ on stall 29 from which it extends in a straight run 33*h*, above the level of the player's fingertips, through the upper ends of stalls 26 and 25 along the sheet 22 to a point $P_4$ on stall 24. It then passes through the stall 24 to the other sheet 23 and returns along a run 33*i* on the level of run 33*h* to the point $P_3$. From there it continues in a sawtooth stitch 33*j* along the outer edge of stall 29, down to the heel portion of the glove where it passes at 33*k* inward along sheet 22 to form another loose undulation 33*m* in the shape of sawtooth stitching 33*b* with alternately longer and shorter loops across a slot 22' opposite slot 23'**.

Next the lace rises on the inner surface of sheet 22 at **33*n* to the crotch between stalls 24 and 28 from which it passes into thumb stall 28 to engage by a loop 33*o*, an annular thong 28' having the same function as the thong 8'' seen in FIG. 1C. It then descends at 33*p* on the inner surface of sheet 23 and traverses, in a run 33*q*, the longer loops of the undualting stretch 33*b* bridging the slot 23'. From there the lace ascends at 33*r*, still on the inner surface of sheet 23, to the crotch between finger stalls 26 and 29, then forming within stall 29 a loop 33*s* engaging an annular thong 29' which has the same function as the thong 9'' seen in FIG. 1B, and returns to the adjoining crotch between the outer edges of stalls 26,29. Finally, the lace descends at 33*t* on the inner surface of sheet 22, traverses the larger loops of the undualtions 33*m* which bridges the slot 22', and rises at 33*v* on the same inner sheet surface to the crotch between stalls 24** and 28 where it ends in an accessible knot K near the web 31.

The effective length of the lace can be adjusted with the aid of knot K to tighten or slacken its U-shaped sections 33*p*, 33*q*, 33*r* and 33*t*, 33*u*, 33*v* which control the width of slots 22', 23', through the tension of the shorter loops of undulations 33*b* and 33*m* when the glove is in use. The yieldability of these loops allows the glove to be curved on the side of either sheet 22, 23, depending on which hand is inserted between the opposite sheet and the padding 27.

Figure 2A:
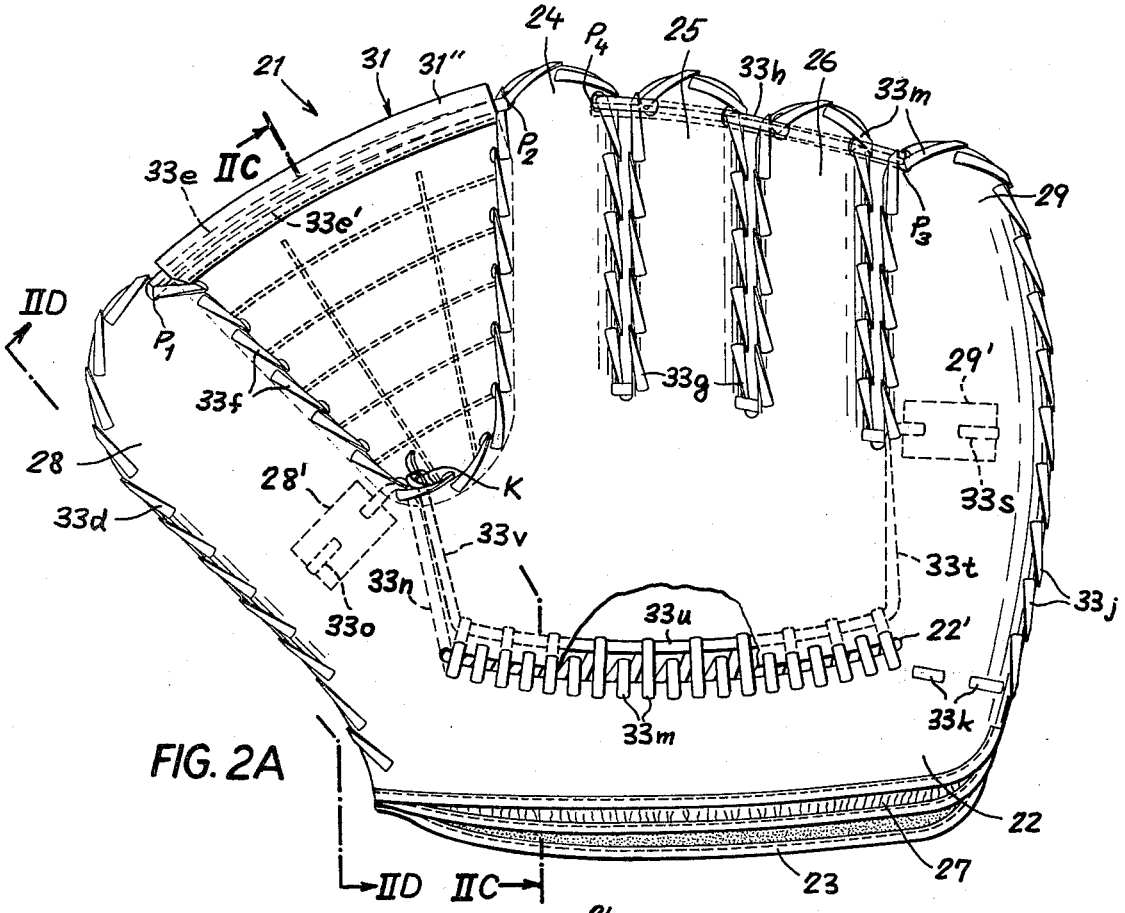
FIG. 2A is an elevational view of one side of a baseball glove according to a second embodiment of my invention, adapted for left-hand use.
Figure 2B:
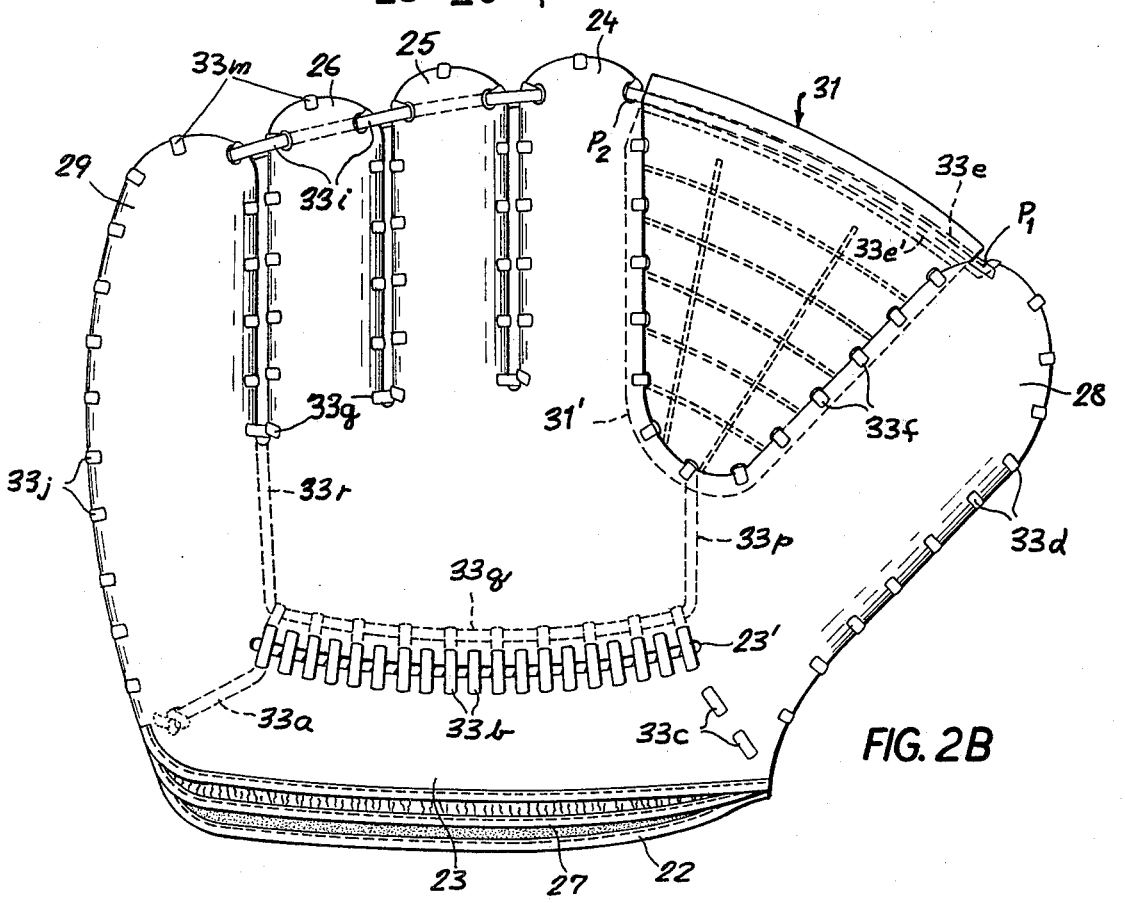
FIG. 2B is an elevational view of the other side of the glove of FIG. 2A, shown adapted for right-hand use.
Figure 2D:
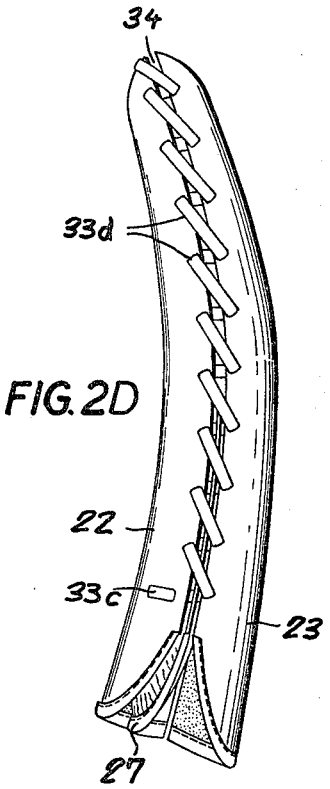
FIG. 2D is an edge view of the same glove as seen from the line IID—IID of FIG. 2A.
Figure 2C:
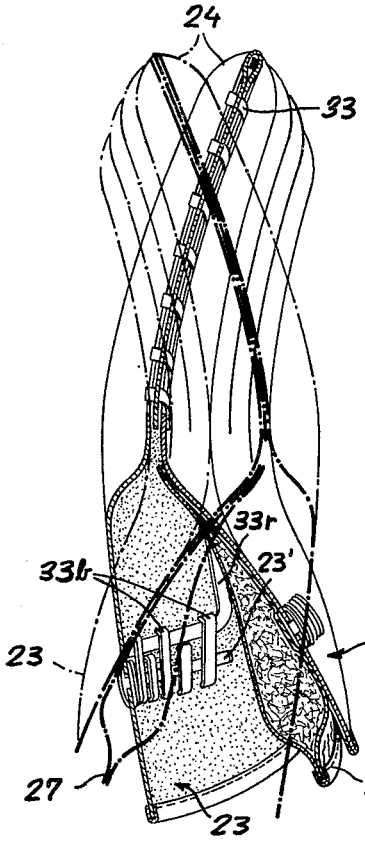
FIG. 2C is a sectional view taken along line IIC—IIC of FIG. 2A.
Figure 3B:
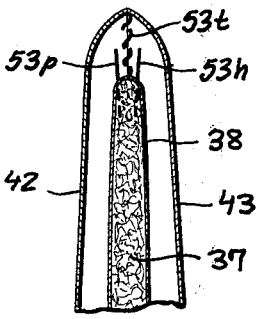
FIG. 3B is a fragmentary sectional view taken on the line IIIB—IIIB of FIG. 3A.
Figure 3A:
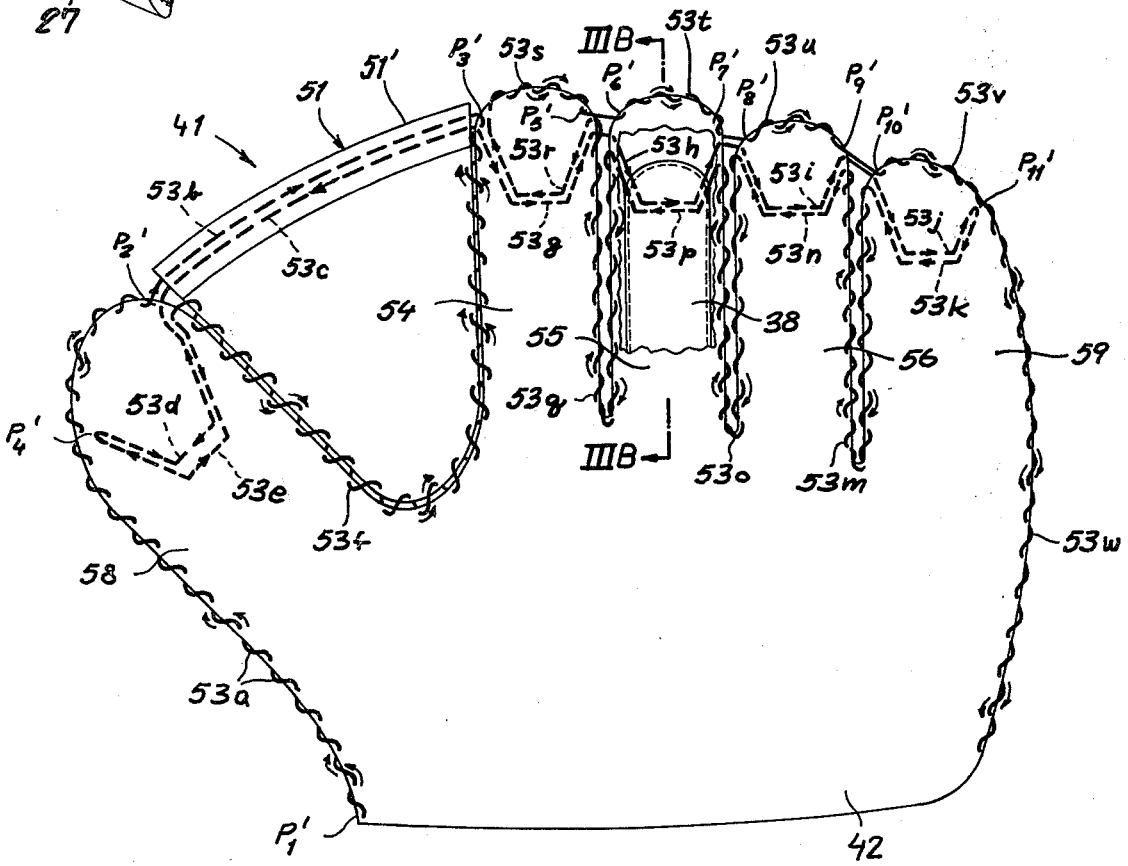
FIG. 3A is a diagrammatic view of a modified baseball glove similar to that of FIG. 2A.

FIGS. 3A and 3B diagrammatically illustrate a glove 41 similar to that shown in FIGS. 2A ∝ 2D, comprising a pair of coextensive front and rear sheets 42, 43 loosely joined together along their peripheries by a single lace, and a web 51 interposed between finger stalls 58 and 54. Between the sheet 42, 43 I provide a pad 37 sheathed in a one-piece lining 38 which is folded around the pad and forms therewith a five-fingered insert extending into stalls 54–56, 58, 59.

Starting at point $P_1'$ and proceeding in a direction marked by small arrows, the lace rises at 53*a* along the outer edge of a thumb stall 58 to a point $P_2'$ whence it passes along a run 53*b* through a channel 51', formed at the upper edge of web 51, to a point $P_3'$ on an adjoining finger stall 54. From there it returns on the same path, along a run 53*c*, to point $P_2'$ from which it hangs down inside thumb stall 58 in a generally trapezoidal loop 53*d* passing into and out of one of the tips of insert 37, 38 (in the manner illustrated for another tip in FIG. 3B) before again linking up with sheet 42 at a point $P_4'$. There the lace crosses over to the other sheet 43 and forms another depending trapezoidal loop 53*e* inside thumb stall 58 again engaging the tip of insert 37, 38. Next the lace interlinks at 53*f* the web 51 and the sheets 42, 43, reaching once more the point $P_3'$ from which it proceeds by a trapezoidal loop 53*g* within finger stall 54 (with engagement of the insert) to a point $P_5'$, crosses over to a point $P_6'$ on stall 55, forms another insert-engaging loop 53*h* to a point $P_7'$, crosses over to a point $P_8'$ on stall 56, passes in a further such loop 53*i* in stall 56 to a point $P_9'$, crosses over to a point $P_{10}'$ on stall 59, and extends in still another insert-engaging loop at 53*j* through this finger stall to a point $P_{11}'$. From there it returns to point $P_{10}'$ along a trapezoidal loop 53*k* engaging the insert 37, 38, follows the confronting edges of stalls 59 and 56 along a path 53*m* to point $P_9'$, forms a further insert-engaging loop 53*n* in stall 56, traces the confronting edges of stalls 56 and 55 along a path 53*o* between points $P_8'$ and $P_7'$, forms still another insert-supporting loop 53*p* in stall 55, extends along the confronting edges of stalls 55 and 54 on a path 53*q* between points $P_6'$ and $P_5'$, and forms with stall 54 yet another trapezoidal loop 53*r* as a further suspension for the insert before crossing over to the inner surface of sheet 43 in the vicinity of point $P_3'$ where it may link up with other stretches previously described. The lace then passes over the tops of finger stalls 54, 55, 56, 59 back to point $P_{11}'$ by forming additional runs 53*s*, 53*t*, 53*u* 53*v* before descending at 53*w* along the outer edge of the glove.

The slack trapezoidal lace portions 53*d*, 53*g*, 53*h*, 53*i*, 53*j* on the inner surface of sheet 42 and 53*e*, 53*r*, 53*p*, 53*n*, 53*k* on the inner surface sheet 43, held in place by stitching not shown, are contacted by the fingertips of the left hand, pressing against padding 37, 38 on the side of sheet 43, or the right hand, pressing against that insert on the side of sheet 42, whereby the tops of the stalls beyond the fingertips of the player are bent in the direction of finger flexure. This curving also tends to separate the loosely laced lateral edges of the two sheets from each other to ventilate the glove. The same side-splitting phenomenon occurs with the similarly laced glove 21 of FIGS. 2A–2D.

Thus, gloves 21 and 41 can both be converted and reconverted for use with either hand at any time with little effort and without requiring extensive relacing. Glove 1, while less readily convertible after initial assembly, uses the same basic components in both instances; if its front and rear sheets as well as the front and rear sides of its stalls 8 and 9 are made identical, and if its lacing is sufficiently yieldable, this glove could also be used for either the right or the left hand without relocation of web 11.

The peripheral gaps present between the sheets of my improved glove allow either or each of these sheets to be designed as a unitary, seamless piece.

The lace portions 33*o*, 33*s* engaging the thongs 28', 29' in FIG. 2A could be inserted in other parts of the continuous lacing (e.g. as extensions of the stretches lining the adjacent finger stalls) in order to be independent of the tension imparted to suspension portions 33*p*, 33*q*, 33*r* and 33*t*, 33*u*, 33*v*.

I claim:

1. In a baseball glove comprising juxtaposed front and rear pieces of tough flexible sheet material provided with a middle finger stall, two intermediate finger stalls and two outer finger stalls, lacing means for peripherally interconnecting said pieces, and a web between one of said outer finger stalls and the adjoining intermediate finger stall, the improvement wherein said outer finger stalls are of symmetrically identical shape and wide enough to accommodate the thumb of a user, said web being selectively retainable by said lacing means between either of said outer finger stalls and the respectively adjoining intermediate finger stall for enabling use with either hand, said outer finger stalls being attached to said front and rear pieces only by said lacing means.

2. The improvement defined in claim 1 wherein said middle finger stall and the outer finger stall opposite said web are interconnected by said lacing means.

3. The improvement defined in claim 1, further comprising padding adjacent the inner surface of said front piece, said padding including downward extensions of said outer finger stalls interconnected by a lace in an area confronting the palm of the user.

4. The improvement defined in claim 3 wherein said padding further comprises a protective layer overlying said extensions on said inner surface.

5. The improvement defined in claim 4 wherein said front piece is integrally provided with a pair of symmetrical lateral flaps foldable about lines diverging downwardly from the outer edges of said intermediate finger stalls, the flap on the side of said web being tucked in at said area between said front piece and said layer, the other flap being extended outwardly and overlying part of the downward extension of the outer finger stall opposite said web.

6. The improvement defined in claim 5 wherein said rear piece has lateral boundaries substantially registering with said downwardly diverging lines.

7. The improvement defined in claim 3, 4, 5 or 6 wherein said rear piece has a cutout in said area partly overlain by a hand-engaging strap.

8. A baseball glove comprising:

substantially coextensive front and rear pieces of tough flexible sheet material forming a thumb stall and four finger stalls separated by a generally U-shaped gap from said thumb stall;

a web occupying said gap; and lacing means spacedly interconnecting said pieces along their peripheries and securing said web thereto, said lacing means forming loose stretches extending across confronting portions of both said pieces for alternate tightening upon insertion of a respective one of a user's hands between said pieces.

9. A baseball glove as defined in claim 8 wherein said lacing means is a single unitary lace.

10. A baseball glove as defined in claim 8 or 9 wherein the tips of said four finger stalls are interconnected by said lacing means.

11. A baseball glove as defined in claim 10 wherein said stretches extend near said tips, further comprising padding interposed between said pieces and provided with extensions in said finger stalls engaged by said stretches in the region of the fingertips of a hand inserted between said padding and either of said pieces.

12. A baseball glove as defined in claim 8 or 9 wherein said pieces are provided with substantially confronting slots in a heel section thereof, said stretches extending across said slots for enabling alternate contraction and expansion the reof.

13. A baseball glove as defined in claim 1 or 8 wherein said pieces are loosely interconnected by said lacing means with formation of peripheral gaps facilitating the circulation of air therebetween.

* * * * *